US009208769B2

(12) United States Patent
Azmi

(10) Patent No.: US 9,208,769 B2
(45) Date of Patent: Dec. 8, 2015

(54) HYBRID ADAPTIVE HEADPHONE

(71) Applicant: Apple Inc., Cupertino, CA (US)

(72) Inventor: Yacine Azmi, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 442 days.

(21) Appl. No.: 13/718,820

(22) Filed: Dec. 18, 2012

(65) Prior Publication Data

US 2014/0169579 A1 Jun. 19, 2014

(51) Int. Cl.

| | |
|---|---|
| ***G10K 11/00*** | (2006.01) |
| ***G10K 11/16*** | (2006.01) |
| ***G10K 11/178*** | (2006.01) |

(52) U.S. Cl.

CPC ..... *G10K 11/16* (2013.01); *G10K 11/178* (2013.01); *G10K 2210/1081* (2013.01); *G10K 2210/3026* (2013.01)

(58) Field of Classification Search

CPC ..... G10K 11/16
USPC ..... 381/71.11, 71.6, 375, 71.1, 74, 370
See application file for complete search history.

(56) References Cited

U.S. PATENT DOCUMENTS

| | | | | |
|---|---|---|---|---|
| 5,555,554 | A | 9/1996 | Hofer et al. | |
| 7,450,691 | B2 | 11/2008 | Short et al. | |
| 8,045,726 | B2 | 10/2011 | Kimura | |
| 8,270,630 | B2 | 9/2012 | Johnson | |
| 8,285,208 | B2 | 10/2012 | Terlizzi | |
| 8,718,291 | B2 * | 5/2014 | Alves et al. | 381/71.11 |
| 2010/0166204 | A1 | 7/2010 | Yanagishita et al. | |
| 2010/0226505 | A1 | 9/2010 | Kimura | |
| 2011/0002478 | A1 | 1/2011 | Pollard et al. | |
| 2011/0033060 | A1 | 2/2011 | Johnson et al. | |
| 2011/0206217 | A1 | 8/2011 | Weis | |
| 2012/0082335 | A1 * | 4/2012 | Duisters et al. | 381/375 |

FOREIGN PATENT DOCUMENTS

| | | |
|---|---|---|
| EP | 1398991 | 8/2007 |
| JP | 2008099163 | 4/2008 |
| WO | WO-2011020992 | 2/2011 |

OTHER PUBLICATIONS

Kuo, Sen M., et al., "Active Noise Control System for Headphone Applications", IEEE Transactions on Control Systems Technology, vol. 14, No. 2, (Mar. 2006), 331-335.

* cited by examiner

*Primary Examiner* — Md S Elahee
(74) *Attorney, Agent, or Firm* — Blakely, Sokoloff, Taylor & Zafman LLP

(57) ABSTRACT

An adaptive noise-cancelling headphone including an earcup housing having a driver for outputting sound to a user positioned therein. The headphone further including an active noise control assembly. The active noise control assembly may include an ambient microphone capable of detecting an ambient noise outside of the housing and an error microphone capable of detecting an earcup noise inside of the housing. Based on the detected noise, active noise cancellation within the headphone is either enabled or disabled. The headphone may further include a passive noise control assembly. The passive noise control assembly may include an acoustic valve associated with an acoustic vent formed within the earcup housing. The acoustic valve is capable of being modified between an open configuration to decrease sound attenuation and a closed configuration to increase sound attenuation in response to the detected ambient noise so as to improve an acoustic performance of the earcup.

21 Claims, 9 Drawing Sheets

HYBRID ADAPTIVE HEADPHONE

FIELD

An embodiment of the invention is directed to a hybrid adaptive headphone having active noise control capability and passive noise control capability. Other embodiments are also described and claimed.

BACKGROUND

Whether listening to a portable media player while traveling, or to a stereo or theater system at home, consumers often choose headphones. Headphones typically include a pair of earcups which encircle the user's ears and are held together by a headband. Headphones can be classified into two general categories based on the design of the earcups, namely closed-back or open-back earcups. Closed-back earcups surround the user's ears and have a sealed back. Open-back earcups also surround the user's ears but have a back which is open to the ambient environment surrounding the earcup.

Both the closed-back and the open-back designs have their own acoustic advantages and disadvantages. Representatively, closed-back earcups have good sound isolation since they are sealed off from ambient noise. In addition, the size and clamp force of the earcups can also be modified to further increase sound isolation. Features of the closed-back design, such as the sealed back, size and clamp force of the earcups allow this design to mechanically or passively attenuate any ambient noise. In some cases, however, closed-back earcups can also make use of an electronic active noise control (ANC) system for additional sound isolation. An ANC system is a noise cancellation system which can attenuate or cancel noise within the earcup by emitting an "antinoise" signal, which is an audio signal having, in theory, the same amplitude and opposite phase to that of the noise such that they cancel each other out.

Due to the closed design of closed-back earcups, however, they have stronger resonances. For example, standing waves can accumulate in the earcups. These standing waves can degrade sound quality and reduce the feeling of openness, which is often desired by a user. In addition, in a quiet environment, residual noise from electrical components within the earcup (e.g., a driver or microphone within the earcup housing) may be heard by the user.

Open-back earcups, on the other hand, have good sound quality due to their low resonances, feel more open to the user, and allow ambient noises to be used to mask some of the residual noises which would otherwise be heard by the user. Open-back earcups, however, cannot be used in noisy environments because their passive attenuation is by definition poor. In addition, since open-back earcups are substantially open to the ambient environment, ANC systems may not be able to efficiently cancel the ambient noise entering the earcup through the open back.

SUMMARY

An embodiment of the invention is a hybrid adaptive noise-cancelling headphone which boasts advantages of both closed-back earcup and open-back earcup designs, as a function of the environment. Representatively, the headphone may include an earcup housing having a driver positioned therein for outputting sound to a user's ear. The driver may be positioned between a front portion of the housing (which is dimensioned to encircle the user's ear) and a back portion of the housing. An active noise control assembly and a passive noise control assembly may be associated with the earcup housing. The active noise control assembly may include an ambient microphone capable of detecting an ambient noise outside of the housing (also referred to as a reference microphone) and an error microphone capable of detecting earcup (residual) noise (inside of the housing). Based on the detected ambient noise and the earcup noise, active noise cancellation within the headphone is either enabled or disabled. The passive noise control assembly may include an acoustic valve associated with an acoustic vent formed within the earcup housing. The acoustic valve is capable of being modified between an open configuration to decrease sound attenuation and a closed configuration to increase sound attenuation in response to the detected ambient noise so as to improve an acoustic performance of the earcup.

An operation of the active noise control assembly and the passive noise control assembly may be controlled by a processor configured to receive one or more of an ambient noise electrical signal and an earcup noise electrical signal output by the ambient microphone and the error microphone, respectively. The processor may compare the ambient noise electrical signal or the earcup noise electrical signal to a predetermined threshold value. Based on the comparison, the processor may instruct the passive noise control assembly to open or close the vent, and the active noise control assembly to enable or disable ANC.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1A:
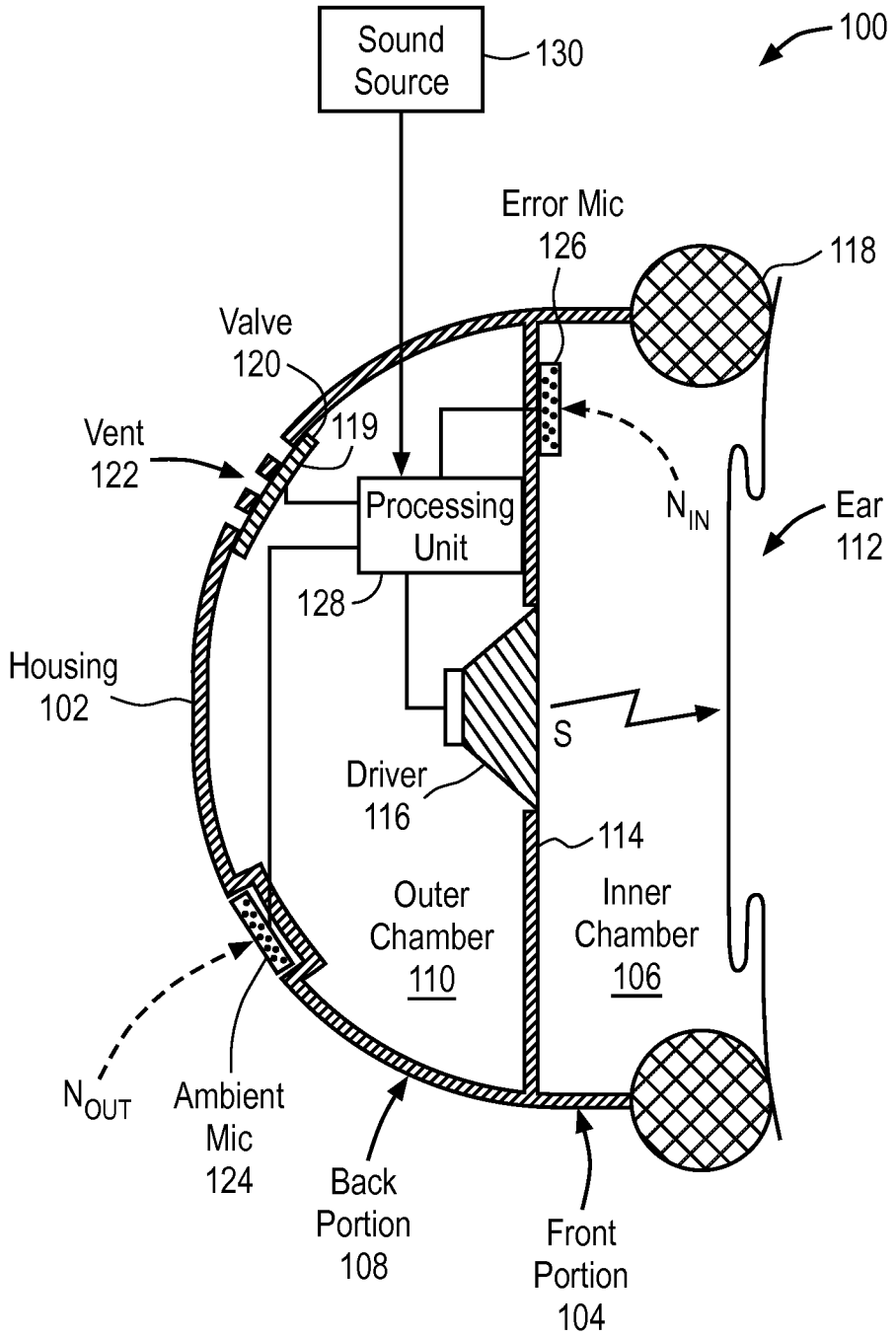
FIG. 1A illustrates a schematic diagram of one embodiment of a hybrid adaptive headphone having a passive noise control assembly in a closed position.
Figure 1B:
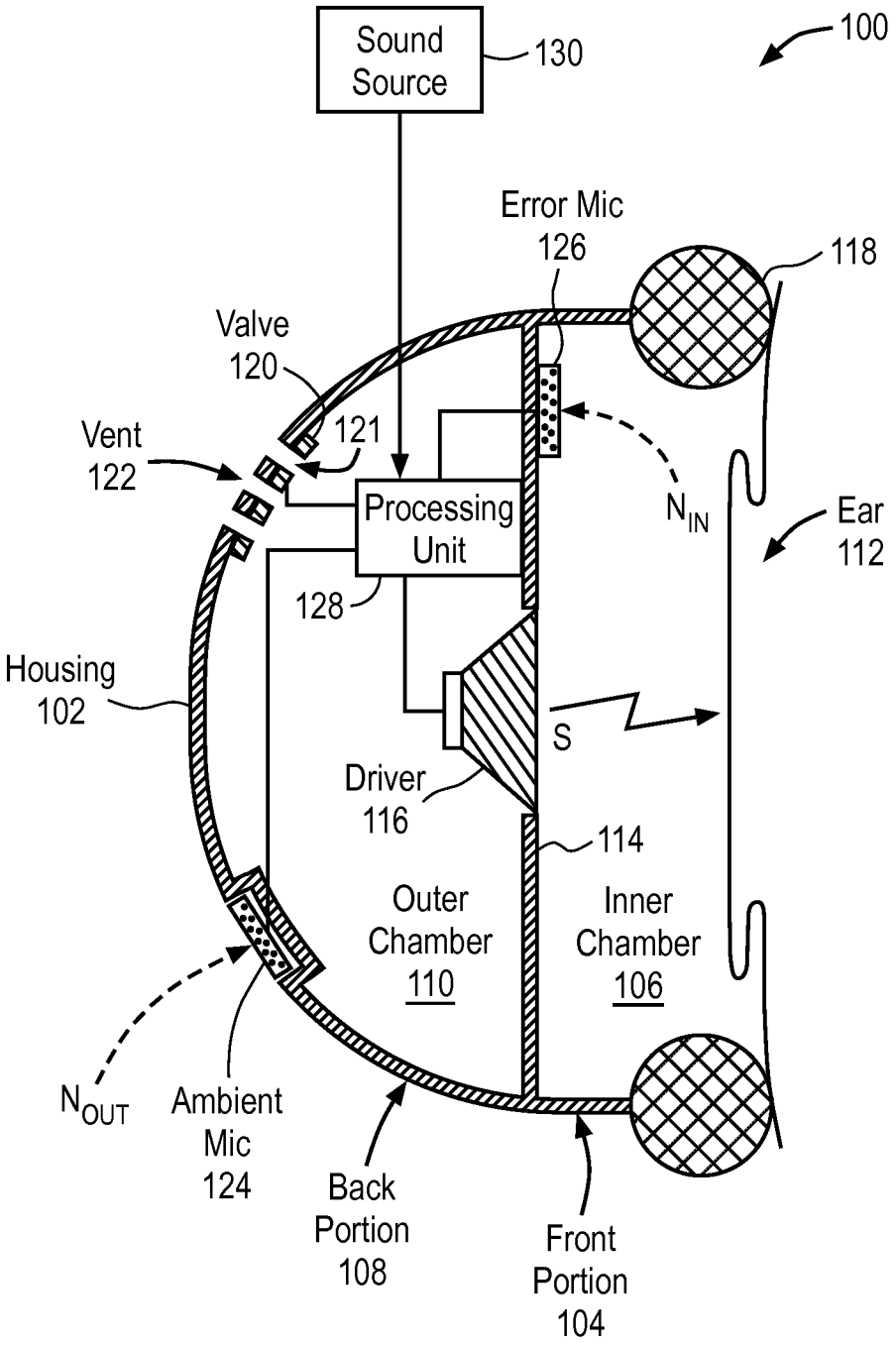
FIG. 1B illustrates a schematic diagram of the headphone of FIG. 1B having the passive noise control assembly in the open position.

FIG. 1A illustrates a schematic diagram of one embodiment of a hybrid adaptive headphone having a passive noise control assembly in a closed position. FIG. 1B illustrates a cross-sectional side view of the headphone of FIG. 1B having the passive noise control assembly in the open position. It should be understood that the figures illustrate only one of a pair of left and right ear earcups of headphone 100, which can be connected by a head band (not shown). Thus, each of the features described in reference to the earcup of headphone 100 illustrated in FIG. 1A and FIG. 1B should be understood as applying to the other earcup of headphone 100. Earcup housing 102 forms an enclosure dimensioned to encircle and cover a user's ear. In this aspect, earcup housing 102 includes a front portion 104 defining an inner chamber 106 and a back portion 108 defining an outer chamber 110. Inner chamber 106 may surround the ear 112 when headphone 100 is positioned on the user's head. In some cases, an earphone pad 118 may be positioned around front portion 104 of earcup housing 102 to ensure a comfortable fit around the user's ear. Outer chamber 110 is a substantially closed chamber (with the exception of the acoustic valve 120, as will be described in more detail below) positioned behind the inner chamber 106 (as viewed in FIG. 1A). Outer chamber 110 may be separated from inner chamber 106 by mid wall 114.

A driver 116 for outputting a music signal (S) in a direction of ear 112 may be mounted within mid wall 114. Driver 116 may be any type of electric-to-acoustic transducer having a pressure sensitive diaphragm and circuitry configured to produce a sound in response to an electrical audio signal input (e.g., a loudspeaker). The electrical audio signal may be a music signal input to driver 116 by sound source 130. Sound source 130 may be any type of audio device capable of outputting an audio signal, for example, an audio electronic device such as a portable music player, home stereo system or home theater system capable of outputting an audio signal.

In order to improve an acoustic performance of headphone 100, headphone 100 may include a passive noise control assembly and an active noise control assembly. The passive noise control assembly may include an acoustic vent 122 formed through earcup housing 102 and an acoustic valve 120. Acoustic valve 120 may be used to control the passage, and therefore attenuation, of ambient noise within earcup housing 102. Acoustic vent 122 and acoustic valve 120 are considered aspects of a passive noise control assembly because they can be used to mechanically attenuate noise within headphone 100 in the absence of an audio signal (e.g., increase or decrease sound attenuation by closing or opening acoustic valve 120). This is in contrast to an active noise control assembly, such as an ANC system, which uses an antinoise signal to attenuate noise. Thus, although an acoustic valve 120 is described and illustrated herein, it is contemplated that any type of modifiable mechanism capable of passively attenuating a noise within earcup housing 102 in response to an ambient noise as described herein may be used (e.g., a piezoelectric or pressure sensitive mechanism capable of opening or closing an acoustic vent or tubing forming a modifiable acoustic vent within the housing).

In some embodiments, acoustic valve 120 may open or close acoustic vent 122 depending upon an ambient noise outside of headphone 100. For example, where the ambient noise outside of headphone 100 is high (e.g., at or above a predetermined ambient noise threshold value found to reduce an acoustic performance of headphone 100), acoustic valve 120 closes to increase attenuation of the undesirable noise. Alternatively, when the ambient noise outside of headphone 100 is low (e.g., below the predetermined threshold value), acoustic valve 120 opens thereby reducing the resonances of headphone 100 and improving user experience. It is further noted that, although not shown, driver 116 may include a front to back leak port, or other feature, that enables sound to vent through driver 116 from one side to the other (e.g., from outer chamber 110 to inner chamber 106) so that the feeling of openness often desired by a user can be experienced when acoustic valve 120 is open. In this aspect, headphone 100 can be considered a hybrid of the previously described closed-back and open-back earcup designs since it can in some cases have a closed-back configuration (e.g., when acoustic valve 120 is closed) and an open-back configuration (e.g., when acoustic valve 120 is open). Headphone 100 is further considered adaptable in that acoustic valve 120 can be modified in response to a noise level of the surrounding or ambient environment.

Representatively, in some embodiments, acoustic valve 120 is configured to automatically close or open in response to an ambient noise ($N_{OUT}$) detected by ambient microphone 124. The ambient noise ($N_{OUT}$) may be considered any noise outside of earcup housing 102. Ambient microphone 124 may be any type of acoustic-to-electric transducer or sensor having a pressure sensitive diaphragm and circuitry configured to convert the ambient noise into an electrical signal (e.g., micro-electrical-mechanical system (MEMS) microphone). In some embodiments, ambient microphone 124 may be positioned along an outer side of earcup housing 102 which faces the ambient environment. In this aspect, any ambient noise ($N_{OUT}$) can be detected by ambient microphone 124. The detected noise ($N_{OUT}$) is then converted by ambient microphone 124 into an ambient noise electrical signal. The ambient noise electrical signal is then transmitted to processing unit 128 (e.g., via a wire) where it is processed and used to determine whether acoustic valve 120 should be in the open or closed position.

Representatively, in one embodiment, the ambient noise electrical signal is compared to a predetermined ambient noise threshold value. The predetermined ambient noise threshold value may correspond to an ambient noise level which has been found to negatively affect the acoustic performance of headphone 100, for example based on subjective perceptions of various users. For example, in some embodiments, the predetermined ambient noise threshold value may be a value greater than or equal to a sound level of from about 50 decibels to about 70 decibels, for example 60 decibels. Thus, assuming in a normal or resting state acoustic valve 120 is open, when the ambient noise ($N_{OUT}$) detected by ambient microphone 124 is determined by processing unit 128 to be equal to or greater than from about 50 decibels to about 70 decibels (e.g., equal to or greater than 60 decibels), instructions are sent to close acoustic valve 120 as shown in FIG. 1A. In the closed configuration, acoustic valve 120 blocks the ambient noise ($N_{OUT}$) from entering acoustic vent 122 and therefore passively increases the attenuation of ambient noise ($N_{OUT}$) within earcup housing 102 so that an intensity of ambient noise ($N_{OUT}$) near the user's ear is reduced. Once the ambient noise ($N_{OUT}$) falls below the predetermined ambient noise threshold value, and is therefore no longer of a level sufficient to interfere with the user's experience (e.g., is less than 60 decibels), instructions are sent to open acoustic valve 120 as shown in FIG. 1B. When acoustic valve 120 is open, the ambient noise ($N_{OUT}$) can enter earcup housing 102 through acoustic vent 122. Since the noise level is determined to be relatively low, however, it will not interfere with the user's experience but rather improve the experience since the feeling of openness often desired by users is now achieved and resonances within earcup housing 102 are reduced. In addition, the passive attenuation of earcup housing 102 may also be reduced due to the openness of earcup housing 102.

Although the embodiments described herein are primarily directed to an acoustic valve 120 which automatically opens or closes in response to an ambient noise level, it is contemplated that in other embodiments, acoustic valve 120 can be a manual valve that can be opened or closed by the user depending upon the individual user's listening preference.

Acoustic valve 120 can be any type of valve capable of opening and closing acoustic vent 122 in response to an external control mechanism, e.g., an electrical signal or, in some cases, a force applied by a user. Representatively, in one embodiment, acoustic valve 120 may include a movable member that can move linearly over acoustic vent 122, rotate over acoustic vent 122, or rotate on a stem (as in a butterfly valve) or a hinge or trunnion (as in a check valve) mounted to earcup housing 102. For example, in one embodiment, acoustic valve 120 may be a disk shaped movable member rotatably mounted over acoustic vent 122. The disk shaped movable member may include openings 121 that align with the openings of acoustic vent 122 in an open position (see FIG. 1B), and solid regions 119 that cover the openings of acoustic vent 122 when the movable member is rotated to the closed position (see FIG. 1A). In the case of an automated valve, which can be controlled by an electrical signal, an actuator such as a motor (e.g., a direct current motor) can be electrically coupled to the movable member such that the input of an electrical signal to the motor (e.g., where the ambient noise ($N_{OUT}$) is above a threshold value) causes the motor to rotate the movable member to an open or closed position with respect to acoustic vent 122. In the case of a manual valve, acoustic valve 120 may include an extension which extends from the movable portion outside of earcup housing 102 so that a user can manually move the movable portion.

As previously discussed, in addition to a passive noise control assembly, headphone 100 may further include an active noise control assembly. The active noise control assembly may include any type of active noise cancelling system capable of emitting a cancelling or antinoise signal for cancelling noise within earcup housing 102. For example, active noise control assembly may be a feedback and/or feedforward ANC system. Representatively, in one embodiment, the active noise control assembly may use the previously discussed ambient microphone 124 for detecting an ambient noise ($N_{OUT}$) and an error microphone 126 for detecting an earcup noise ($N_{IN}$) within inner chamber 106. Similar to ambient microphone 124, error microphone 126 may be any type of acoustic-to-electric transducer or sensor having a pressure sensitive diaphragm and circuitry capable of converting earcup noise ($N_{IN}$) into an electrical signal (e.g., a MEMS microphone). Error microphone 126 is mounted within inner chamber 106 so that it can detect noise within earcup housing 102 that could be heard by a user and interfere with the listening experience. The earcup noise ($N_{IN}$) detected by error microphone 126 may then be converted to an earcup noise electrical signal and transmitted to processing unit 128. Processing unit 128 may then process both the earcup noise electrical signal and the ambient noise electrical signal (e.g., compare the signals) to determine whether ANC within earcup housing 102 is necessary. Processing unit 128 may determine that ANC is desirable where, for example, earcup noise ($N_{OUT}$) is above a predetermined threshold value found to negatively interfere with a user's listening experience. Where ANC is necessary, processing unit 128 will generate a cancelling or antinoise signal having an amplitude equal to, but of a different phase than, the earcup noise to be cancelled. The cancelling signal will then be transmitted from processing unit 128 to driver 116, which in turn, outputs the cancelling signal to inner chamber 106 so that any undesired earcup noise ($N_{IN}$) is cancelled before reaching the user's ear. The cancelling signal may be transmitted along with, or separate from, a music signal (S) transmitted to driver 116 by sound source 130 for output to the user. It is noted that although an active noise control assembly using both the ambient microphone 124 and error microphone 126 to determine whether to enable or disable ANC is described, it is contemplated that the active noise control assembly may, in some embodiments, operate based on noise detected by a single microphone, for example ambient microphone 124 or error microphone 126 alone.

Each of the above-described passive and active noise control assemblies may be operated at the same time or at different times depending upon the detected noise level. For example, in an environment where the noise level is relatively high such that the detected ambient noise ($N_{OUT}$) is above the predetermined ambient noise threshold value, the passive noise control assembly may close acoustic valve 120 in order to increase attenuation of the undesired ambient noise. The active noise control assembly may or may not be enabled in this instance since the earcup noise ($N_{IN}$) may or may not be above the predetermined earcup noise threshold value. For example, although ambient noise ($N_{OUT}$) may be considered relatively high, it may be attenuated enough by earcup housing 102 and the closure of acoustic valve 120 that ANC is not necessary. Alternatively, if earcup noise ($N_{IN}$) is determined to be above the predetermined threshold value, ANC may be enabled such that both passive and active noise control assemblies are used to control the noise level within earcup housing 102. In another embodiment where the environmental noise level is considered to be relatively low (e.g., the ambient noise is below the predetermined threshold value), acoustic valve 120 may be opened and ANC may be disabled (e.g., no cancelling signal is generated) such that high audio quality can be recovered.

Figure 2A:
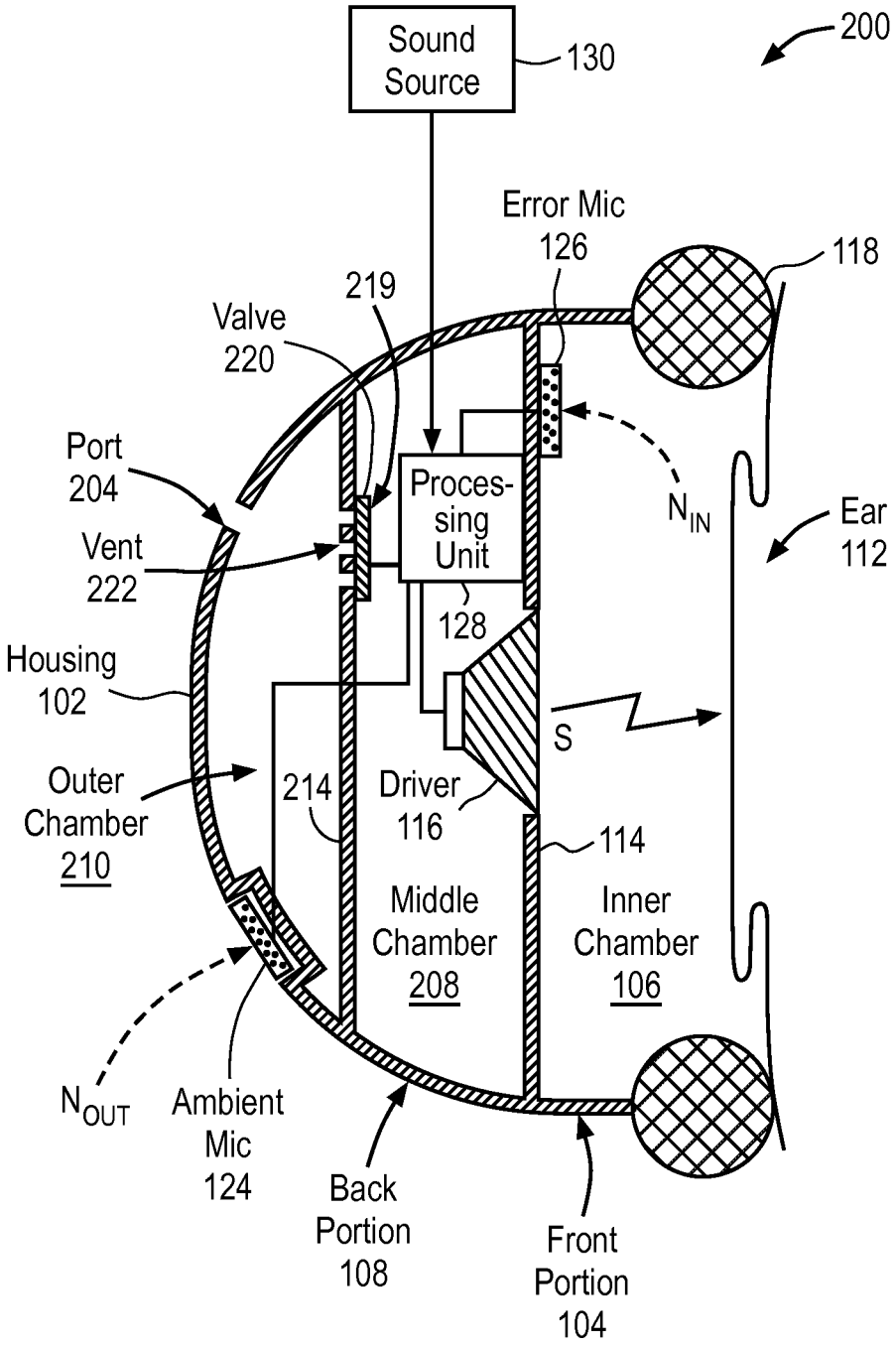
FIG. 2A illustrates a schematic diagram of one embodiment of a hybrid adaptive headphone having a passive noise control assembly in a closed position.
Figure 2B:
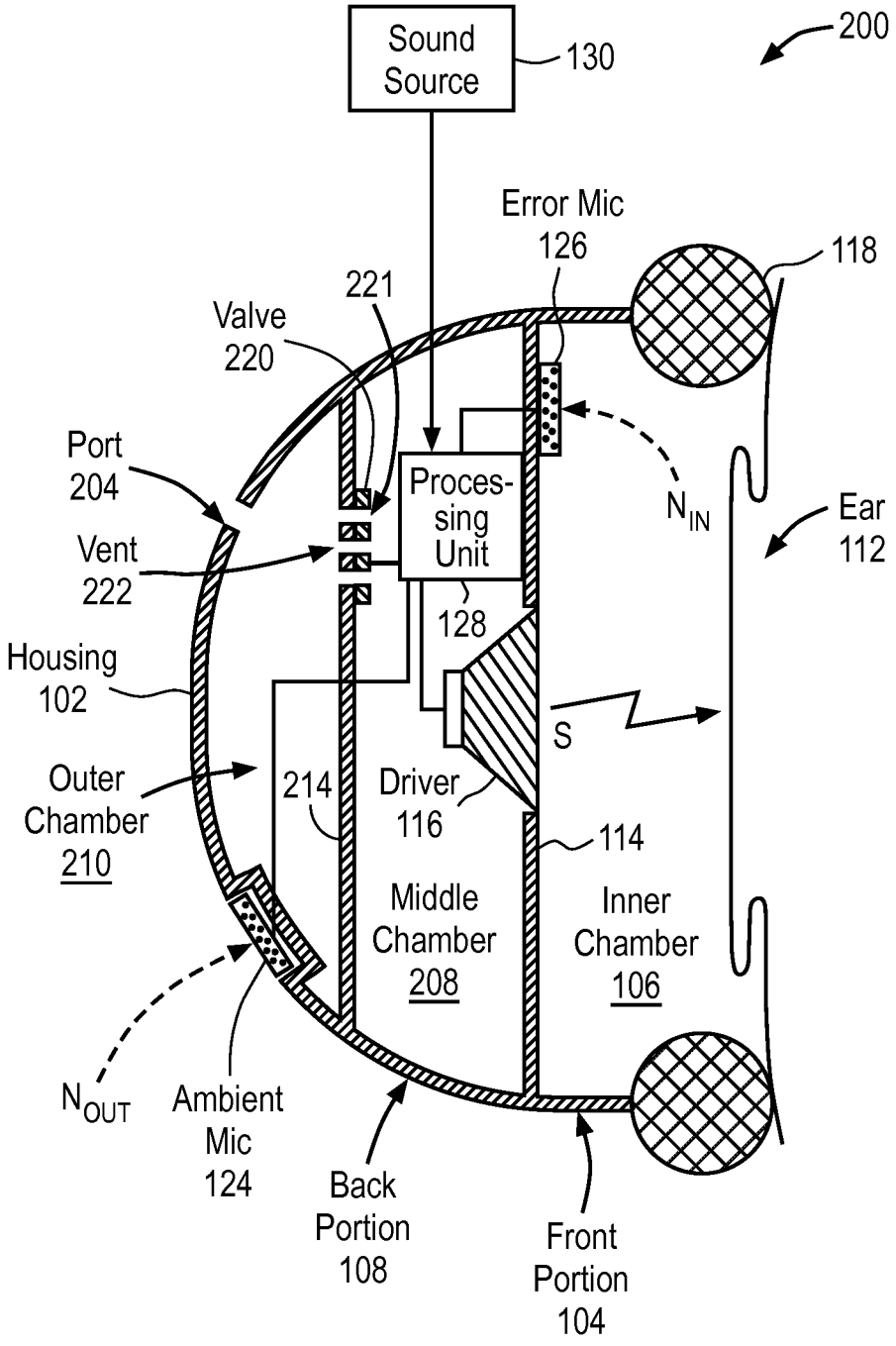
FIG. 2B illustrates a schematic diagram of the headphone of FIG. 2B having the passive noise control assembly in the open position.

FIG. 2A illustrates a cross-sectional side view of one embodiment of a hybrid adaptive headphone having a passive noise control assembly in a closed position. FIG. 2B illustrates a cross-sectional side view of the headphone of FIG. 2B having the passive noise control assembly in the open position. Similar to FIGS. 1A-1B, only one of a pair of left and right ear earcups, which can be connected by a head band (not shown), are illustrated. Thus, each of the features described in reference to the earcup of headphone 200 illustrated in FIG. 2A and FIG. 2B should be understood as applying to the other earcup of headphone 200. Headphone 200 may be substantially similar to headphone 100 and include similar features and operate in a similar manner except that in this embodiment, acoustic vent 222 is formed through an outer mid wall 214, which divides the back portion 108 of earcup housing 102 into two separate chambers, namely a middle chamber 208 and an outer chamber 210. Middle chamber 208 is dimensioned to contain driver 116, which is ported to inner chamber 106, and processing unit 128. Outer chamber 210 is dimensioned to form a substantially open acoustic volume behind middle chamber 208. Acoustic valve 220 is positioned along outer mid wall 214, and over acoustic vent 222. Acoustic valve 220 and acoustic vent 222 may be substantially similar to any of the vent and valve configurations discussed in reference to FIGS. 1A-1B, e.g., a movable member with solid portions 219 and open portions 221 which can be rotated so that the solid portions 219 cover the openings in acoustic vent 222 in the closed configuration and so that open portions 221 are aligned with openings in acoustic vent 222 in the open configuration. In this aspect, when acoustic valve 220 is in the closed configuration (as illustrated in FIG. 2A), middle chamber 208 is substantially acoustically sealed off from outer chamber 210. When acoustic valve 220 is in the open configuration (as illustrated in FIG. 2B), middle chamber 208 is acoustically coupled with outer chamber 210. An acoustic port 204 is further formed through a portion of earcup housing 102 such that in the open configuration, any desired ambient sound or noise may pass through acoustic port 204 and into inner chamber 106 thus enhancing the acoustic performance and increasing the feeling of openness of headphone 200.

Similar to headphone 100 described in reference to FIGS. 1A-1B, headphone 200 may be considered a hybrid adaptive headphone in that headphone 100 also includes a passive noise control assembly and an active noise control assembly. Representatively, the passive noise control assembly may include acoustic vent 222 and acoustic valve 220, which can be opened or closed depending upon the ambient noise ($N_{OUT}$) detected by ambient microphone 124. The active noise control assembly may include any type of active noise cancelling (ANC) system capable of emitting a cancelling signal for cancelling noise within earcup housing 102. Representatively, in one embodiment, the active noise control assembly may include the previously discussed ambient microphone 124 for detecting an ambient noise ($N_{OUT}$) and an error microphone 126 for detecting an earcup noise ($N_{IN}$) within inner chamber 106. Processing unit 128 may be used to process both an earcup noise electrical signal output by error microphone 126 and an ambient noise electrical signal output by ambient microphone 124 to determine whether passive noise control and/or ANC within earcup housing 102 is necessary.

The passive and active noise control assemblies may be operated at the same time or at different times depending upon the detected noise level. For example, in an environment where the noise level is relatively high such that the detected ambient noise ($N_{OUT}$) is above an ambient noise predetermined threshold value, the passive noise control assembly may close acoustic valve 220 in order to increase attenuation of the undesired ambient noise. The active noise control assembly may or may not be enabled in this embodiment since the earcup noise ($N_{IN}$) may or may not be above the earcup predetermined threshold value. For example, although ambient noise ($N_{OUT}$) may be considered relatively high, it may be attenuated enough by earcup housing 102 and the closure of acoustic valve 220 that ANC is not necessary. Alternatively, if the earcup noise ($N_{IN}$) is determined to be above the predetermined threshold value, ANC may be enabled such that both passive and active noise control assemblies are used to control the noise level within earcup housing 102. In another embodiment where the environmental noise level is considered to be relatively low (e.g., the ambient noise is below the predetermined threshold value), acoustic valve 220 may be opened and ANC may be disabled (e.g., no cancelling signal is generated) such that high audio quality can be recovered.

Although the embodiments described herein are primarily directed to an acoustic valve 220 which automatically opens or closes in response to an ambient noise level, it is contemplated that in other embodiments, acoustic valve 220 can be a manual valve that can be opened or closed by the user depending upon the individual user's listening preference.

Figure 3:
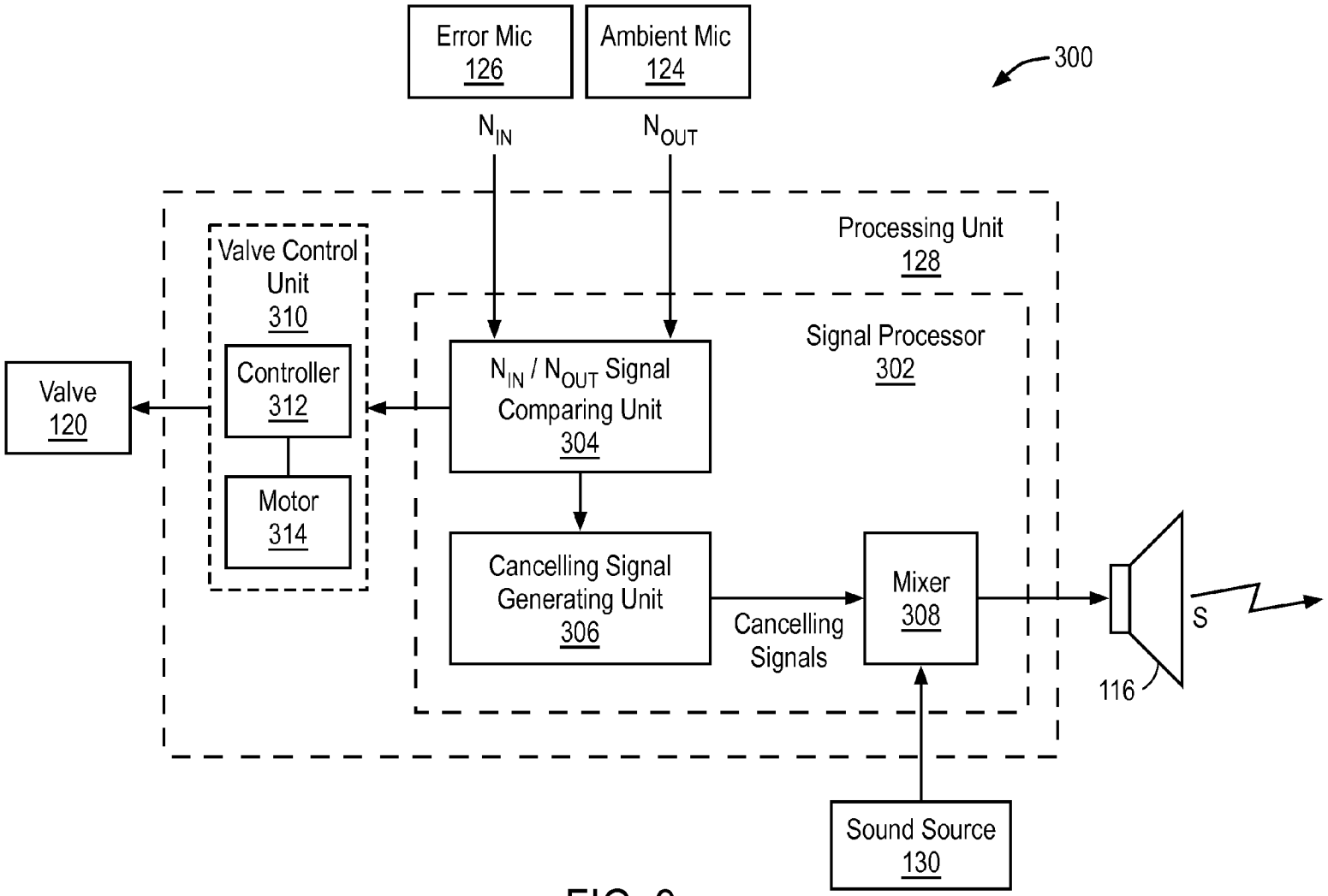
FIG. 3 illustrates a block diagram showing one embodiment of an operation of a noise control assembly.

FIG. 3 illustrates a block diagram showing one embodiment of an operation of a noise control assembly. Noise control assembly 300 may include a processing unit 128, which includes various processing components configured to drive the operation of the passive noise control assembly and the active noise control assembly as will now be described in more detail. In one embodiment, processing unit 128 may include a signal processor 302, which may in some embodiments be a digital signal processor (DSP). Signal processor 302 may include various signal processing components, including but not limited to, a signal comparing unit 304, a cancelling signal generating unit 306 and a mixer 308 for processing of the ambient noise electrical signals from ambient microphone 124 and/or earcup noise electrical signals from error microphone 126. Representatively, during an operation of headphone 100, any ambient noise electrical signals and/or earcup noise electrical signals detected by ambient microphone 124 and/or error microphone 126, respectively, are input to signal comparing unit 304. Signal comparing unit 304 may include circuitry configured to determine the ambient noise level from the ambient noise electrical signals and/or the earcup noise level from earcup noise electrical signals. The determined noise level may then be compared to a predetermined threshold value by signal comparing unit 304 to determine whether passive and/or active noise control is necessary. For example, where the ambient noise electrical signals are determined to be above a predetermined ambient noise threshold value (e.g., about 60 decibels), instructions to close the valve 120 (or valve 220) may be sent to a valve control unit 310. Alternatively, where the ambient noise electrical signals are determined to be below the predetermined ambient noise threshold value, instructions to open the valve 120 (or valve 220) may be sent to a valve control unit 310. Valve control unit 310 may include, for example, a controller 312 including circuitry configured to process the instructions and send an electrical current to motor 314, which is in turn configured to actuate the valve 120 (or valve 220) (i.e., open or close the valve). It is further contemplated that in addition to, or instead of motor 314, a switch may be used to actuate or control an electrical input to valve 120.

Still further, in the case of the active noise control assembly operation, signal comparing unit 304 can compare the ambient noise electrical signals, the earcup electrical signals and/or music sound signals (S) to each other and/or a threshold value, to determine whether ANC is necessary. Representatively, in one embodiment, signal comparing unit 304 may determine based on a comparison of the ambient electrical signals to the earcup electrical signals or one or more of these signals to a predetermined threshold value, that a user's listening experience could be improved by enabling ANC. For example, the predetermined threshold value may be any ambient noise value or earcup noise value found, based on field studies, to interfere with a user's listening experience. Instructions may then be sent to cancelling signal generating unit 306 to generate a cancelling signal or antinoise signal sufficient to cancel the undesired earcup noise. The cancelling signals generated by cancelling signal generating unit 306 may then be sent to mixer 308. The cancelling signal output by cancelling signal generating unit 306 may be synthesized with the musical signal (S) input by sound source 130 and sent to driver 116 for output to the user.

Although not illustrated in FIG. 3, it is to be understood that, a battery or other power source for noise control assembly 300 may be included within the associated headphone. It is further to be understood that noise control assembly 300 is shown generically in FIG. 3 for clarity. Persons skilled in the art can, however, appreciate that any one or more of the components discussed herein can be omitted, modified, combined, and/or rearranged, and any additional processing components and/or circuitry necessary for processing of noise electrical signals and operation of a passive noise control assembly and an active noise control assembly may be included without departing from the scope of the invention. Representative components and/or circuitry that may be included but are not illustrated in FIG. 3 may include, but are not limited to, amplifiers, filters, phase adjusters, signal converters, memory, additional processors and the like. It is further to be understood that in some embodiments, each of the components and/or circuitry of processing unit 128 are integrated within headphone 100 such that the signal processing and operating decisions take place within headphone 100. In other embodiments, one or more components of processing unit 128 may be integrated within an electronic device remote to headphone 100 such that signal processing and/or operating decisions are performed outside of headphone 100 and the operating instructions are transferred to headphone 100 (e.g., via a wire or wirelessly) for execution. For example, processing unit 128 (including, for example, signal comparing unit 304, cancelling signal generating unit 306 and mixer 308) may be integrated within sound source 130 or a chip configured to collect noise electrical signals, process the signals and transfer the signals, in some cases along with instructions, to a host device (e.g., headphone 100).

Figure 4:
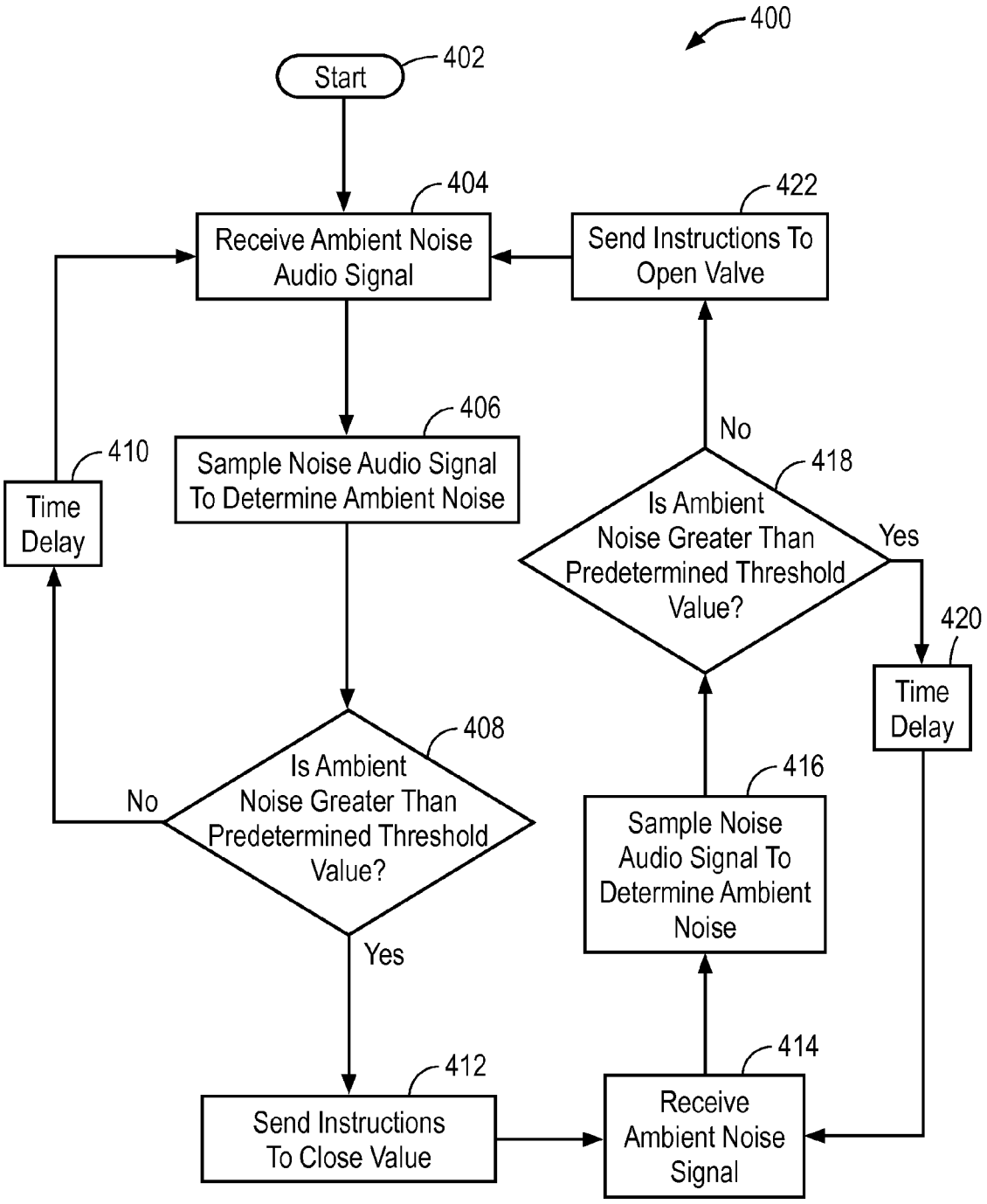
FIG. 4 is a simplified logic flow chart of an illustrative mode of operation in accordance with one embodiment of a hybrid adaptive headphone.

FIG. 4 is a simplified logic flow chart of an illustrative mode of operation in accordance with one embodiment of a passive noise control assembly in accordance with one embodiment of a hybrid adaptive headphone. Operation of the passive noise control assembly may include process 400 which represents one embodiment for a processing unit which determines when to turn on or turn off a passive noise control assembly (e.g., close or open housing valve 120 or valve 220). It should be understood that the processes discussed here and in the processes to follow are intended to be illustrative and not limiting. Persons skilled in the art can appreciate that steps of the processes discussed herein can be omitted, modified, combined, and/or rearranged, and any additional steps can be performed without departing from the scope of the invention. For example, although a single valve in an open or closed state is disclosed, it is contemplated that multiple valves may be provided and one or more of the valves may have incremental opening steps.

Process 400 can start at step 402 and proceed to step 404. In step 404, an audio signal can be received. The audio signal can be received, for example, by one or more microphones of a headphone (e.g., ambient microphone 124). If, instead of the headphone, an electronic device in communication with the headphone (e.g., an audio electronic device) is performing the signal processing of the audio signal, then the audio signal can be first received by the electronic device, and then transferred to the headphone for subsequent processing (e.g., via a wire or wirelessly). The audio signal may contain an ambient noise detected outside of headphone.

In step 406, the audio signal can be sampled by, for example, a signal processor, such as signal processor 302 of FIG. 3, in order to determine the level of ambient noise that is present. Any suitable form of noise sampling or noise analysis can be performed in order to determine the amount of ambient noise present. As one example, the signal processor can analyze the frequency spectrum of the audio signal that is received in step 404 in order to determine the amount of ambient noise present in the audio signal.

In step 408, the signal processor can compare the amount of noise to a predetermined threshold value. For example, the signal processor can compare the detected ambient noise to a predetermined ambient noise threshold value. The predetermined ambient noise threshold value can be a default system value that is determined by, for example, the system distributor or manufacturer. Alternatively, a user can manually set a predetermined noise threshold value for process 400. In yet another embodiment, the predetermined noise threshold value can be a dynamic value which changes based on factors such as the power supply of the headphone, a device in communication with the headphone, the ratio of the earcup noise to the ambient noise, etc.

In response to the noise not being greater than the predetermined threshold value, the system can proceed to step 410. In step 410, process 400 can wait for a pre-determined time delay. After the time delay, process 400 can return to step 404 and once again receive an audio signal. Thus, process 400 can repeatedly loop through steps 404, 406, 408, and 410 and sample the audio signal until the ambient noise is greater than the predetermined ambient noise threshold value. The value of the time delay in step 410 will determine the frequency at which process 400 samples the audio signal. Alternatively, if it is desired to continuously sample the audio signal, step 410 can be removed.

In response to the noise being greater than the predetermined ambient noise threshold value, process 400 can proceed to step 412 and send instructions to close the passive noise control assembly valve. For example, if the data processing is being done in the headphone, the instructions are sent to the valve control unit 310 of FIG. 3, located within the headphone. Alternatively, if the data processing is being done in an associated audio electronic device (e.g., a high-fidelity stereo system or home theater system), the instructions can be sent to a headphone that is in communication with the audio electronic device.

After the valve is closed, process 400 can proceed to step 414 and can once again sample the audio signal. Steps 414, 416, 418, and 420 can operate in the same manner as steps 404, 406, 408, and 410 except, since the valve is already closed, the steps can continue to loop and repeat as long as the level of noise is greater than the predetermined ambient noise threshold value. For example, in step 414 an audio signal can be received. In step 416, this audio signal can be sampled to determine the level of noise present in the audio signal. In step 418, process 400 can determine if the ambient noise is greater than the predetermined ambient noise threshold value. In response to the noise being greater than the predetermined ambient noise threshold value, process 400 can proceed to step 420 and wait for a pre-determined time delay, and can then return to step 414. Thus, as long as a received audio signal contains undesired noise that is greater than the predetermined ambient noise threshold value, steps 414, 416, 418, and 420 can continue to loop and the valve can remain closed. In response to the noise level being less than the predetermined ambient noise threshold value in step 418, process 400 can proceed to step 422 and send instructions to open the valve.

Process 400 can then return to step 404 and once again repeat steps 404, 406, 408, and 410 until the undesired noise levels rises above the predetermined ambient noise threshold value. In this manner, process 400 can continuously monitor the amount of noise and suitably close or open the valve of passive noise control assembly. Process 400 can continue to operate as long as the system is on. For example, process 400 can continue to operate until a headphone is turned off, until a headphone is no longer in communication with an electronic audio device, until a user manually turns off process 400, etc. Additionally, one skilled in the art can appreciate that the predetermined ambient noise threshold value in step 408 and the predetermined ambient noise threshold value in step 418 are not required to be the same value, and that different threshold values can be used to determine when to open and/or close the associated valve.

Figure 5:
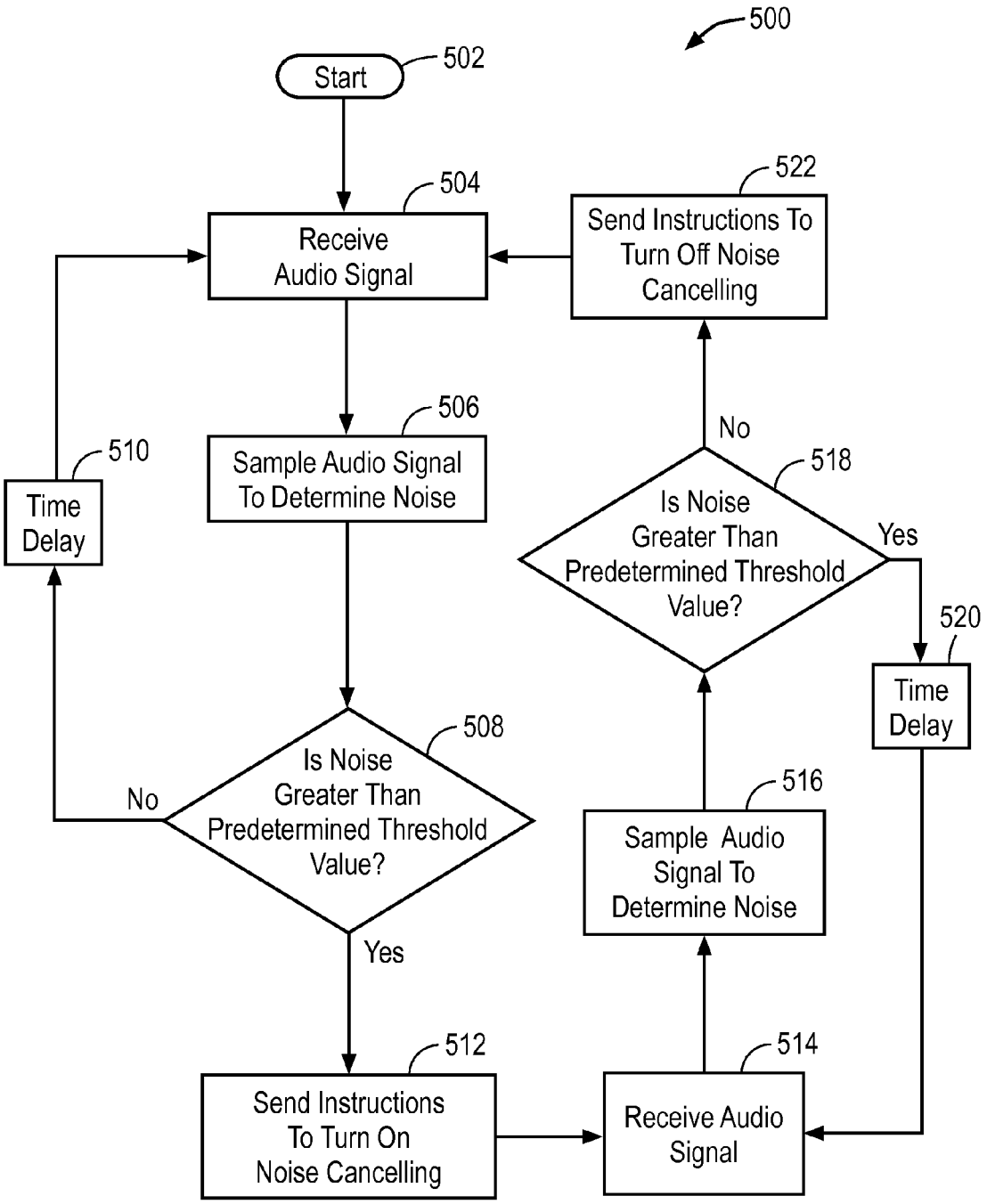
FIG. 5 is a simplified logic flow chart of an illustrative mode of operation in accordance with one embodiment of a hybrid adaptive headphone.

FIG. 5 is a simplified logic flow chart of an illustrative mode of operation of an active noise control assembly in accordance with one embodiment of a hybrid adaptive headphone. Operation of the active noise control assembly may include process 500 which represents one embodiment for a processing unit which determines when to turn on (enable) or turn off (disable) active noise cancellation. It should be understood that the processes discussed here and in the processes to follow are intended to be illustrative and not limiting. Persons skilled in the art can appreciate that steps of the processes discussed herein can be omitted, modified, combined, and/or rearranged, and any additional steps can be performed without departing from the scope of the invention.

Process 500 can start at step 502 and proceed to step 504. In step 504, an audio signal can be received. The audio signal can be received, for example, by one or more microphones of a headphone (e.g., ambient microphone 124 and/or error microphone 126). If, instead of the headphone, an electronic device in communication with the headphone (e.g., an audio electronic device) is performing the signal processing of the audio signal, then the audio signal can be first received by the electronic device, and then sent to the headphone for subsequent processing. The audio signal may contain an ambient noise detected outside of headphone and/or an earcup noise detected within the headphone.

In step 506, the audio signal can be sampled by, for example, a signal processor, such as signal processor 302 of FIG. 3, in order to determine the level of ambient noise or earcup noise that is present. Any suitable form of noise sampling or noise analysis can be performed in order to determine the amount of ambient or earcup noise present. As one example, the signal processor can analyze the frequency spectrum of the audio signal that is received in step 504 in order to determine the amount of ambient or earcup noise present in the audio signal.

In step 508, the signal processor can compare the amount of noise to a predetermined noise threshold value. For example, the signal processor can compare the detected ambient and/or earcup noise to a predetermined noise threshold value. The predetermined noise threshold value can be a default system value that is determined by, for example, the system distributor or manufacturer. Alternatively, a user can manually set a predetermined noise threshold value for process 500. In yet another embodiment, the predetermined threshold value can be a dynamic value which changes based on factors such as the power supply of the headphone, a device in communication with the headphone, the ratio of the earcup noise to the ambient noise, etc.

In response to the noise not being greater than the predetermined threshold value, the system can proceed to step 510. In step 510, process 500 can wait for a pre-determined time delay. After the time delay, process 500 can return to step 504 and once again receive an audio signal. Thus, process 500 can repeatedly loop through steps 504, 506, 508, and 510 and sample the audio signal until the noise is greater than the predetermined threshold value. The value of the time delay in step 510 will determine the frequency at which process 500 samples the audio signal. Alternatively, if it is desired to continuously sample the audio signal, step 510 can be removed.

In response to the noise being greater than the predetermined threshold value, process 500 can proceed to step 512 and send instructions to turn on (enable) the noise control assembly, and in turn ANC. For example, if the data processing is being done in the headphone, the instructions are sent to the cancelling signal generating unit 306 of FIG. 3, located within the headphone. Alternatively, if the data processing is being done in an associated audio electronic device (e.g., a high-fidelity stereo system or home theater system), the instructions can be sent to a headphone that is in communication with the audio electronic device.

After the noise cancelling has been turned on, process 500 can proceed to step 514 and can once again sample the audio signal. Steps 514, 516, 518, and 520 can operate in the same manner as steps 504, 506, 508, and 510 except, since the noise cancelling system is already on, the steps can continue to loop and repeat as long as the level of noise is greater than the predetermined threshold value. For example, in step 514 an audio signal can be received. In step 516, this audio signal can be sampled to determine the level of noise present in the audio signal. In step 518, process 500 can determine if the ambient noise is greater than the predetermined threshold value. In response to the noise being greater than the predetermined threshold value, process 500 can proceed to step 520 and wait for a pre-determined time delay, and can then return to step 514. Thus, as long as a received audio signal contains undesired noise that is greater than the predetermined threshold value, steps 514, 516, 518, and 520 can continue to loop and the noise cancelling system can remain turned on. In response to the noise level being less than the predetermined noise threshold value in step 518, process 500 can proceed to step 522 and send instructions to turn off the noise cancelling system.

Process 500 can then return to step 504 and once again repeat steps 504, 506, 508, and 510 until the undesired noise levels rises above the predetermined threshold value. In this manner, process 500 can continuously monitor the amount of noise and suitably turn off (disable) or turn on (enable) the active noise control assembly. Process 500 can continue to operate as long as the system is on. For example, process 500 can continue to operate until a headphone is turned off, until a headphone is no longer in communication with an electronic audio device, until a user manually turns off process 500, etc. Additionally, one skilled in the art can appreciate that the predetermined threshold value in step 508 and the predetermined threshold value in step 518 are not required to be the same value, and that different threshold values can be used to determine when ANC is turned on and when ANC is turned off.

It is to be appreciated that although the passive noise control assembly process 400 of FIG. 4 and the active noise control assembly process 500 of FIG. 5 are separately, processes 400 and 500 can be performed continuously and simultaneously by, for example, processing unit 128 illustrated in FIGS. 1A-1B, FIGS. 2A-2B and FIG. 3. In this aspect, noise within an earcup housing of headphone can be both passively and actively attenuated any given time, where necessary, to achieve optimal headphone performance.

Figure 6:
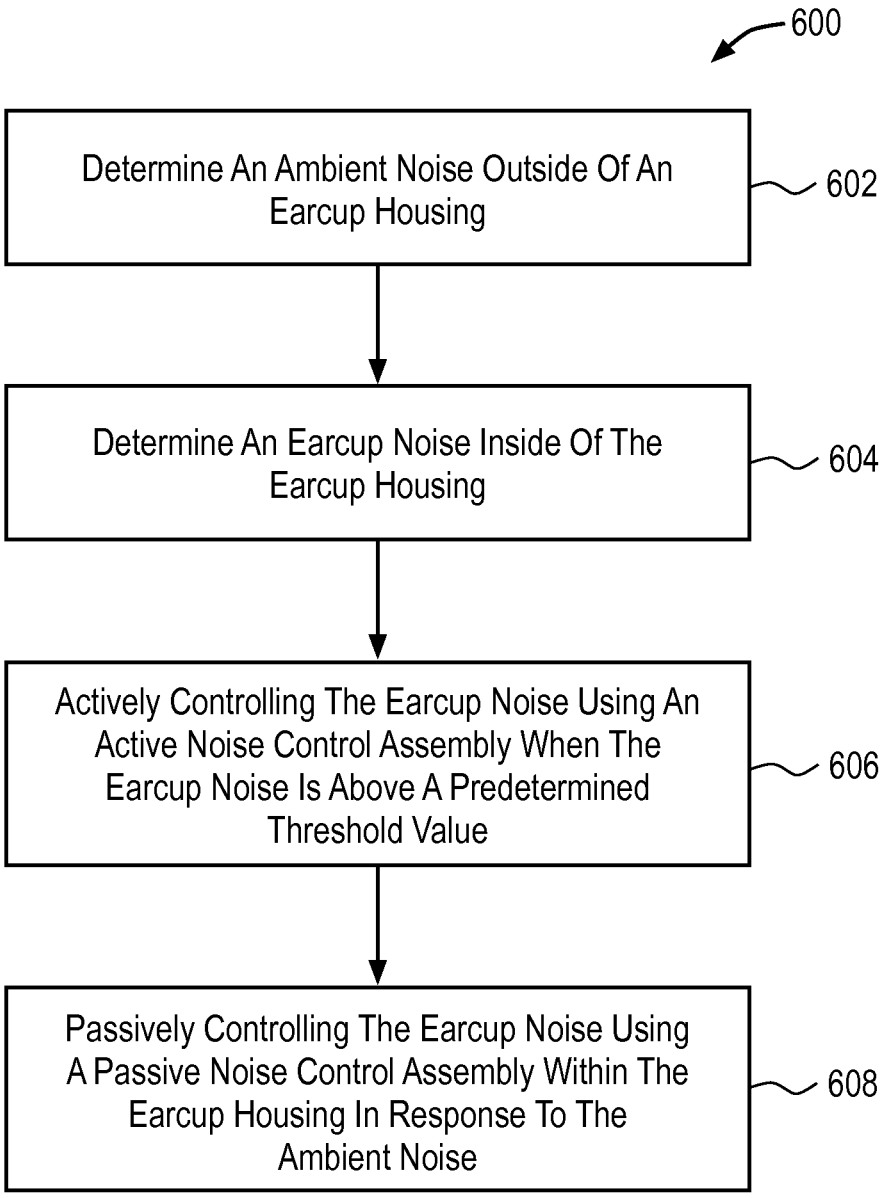
FIG. 6 is a flow chart of an illustrative mode of operation in accordance with one embodiment of a hybrid adaptive headphone.

FIG. 6 is a flow chart of an illustrative mode of operation of a passive noise control assembly and an active noise control assembly in accordance with one embodiment of a hybrid adaptive headphone. Representatively, in one embodiment, process 600 includes determining an ambient noise outside of an earcup housing (block 602). The ambient noise outside of the earcup housing may be determined by, for example, analyzing an ambient noise electrical signal output by an ambient microphone mounted to the earcup housing as previously discussed. Process 600 may further include determining an earcup noise inside of the earcup housing (block 604). The earcup noise may be determined by, for example analyzing the ambient noise electrical signal and an earcup noise electrical signal output by an error microphone mounted within the earcup housing as previously discussed. Process 600 may further include actively controlling the earcup noise using an active noise control assembly when the earcup noise is above a predetermined threshold value (block 606). Representatively, as previously discussed, when the detected earcup noise is above a predetermined threshold value, the active noise control assembly may generate a noise cancelling signal sufficient to cancel the undesirable noise. The earcup noise may also be passively controlled using a passive noise control assembly, which can be operated in response to the detected ambient noise (block 608). Representatively, passively controlling the earcup noise may include opening a valve within the earcup housing to decrease attenuation of the ambient noise when the ambient noise is below a predetermined threshold value. In still further embodiments, passively controlling the earcup noise may include closing a valve within the earcup housing to increase attenuation of the ambient noise when the ambient noise is above a predetermined threshold value. The predetermined threshold value for passive noise control may be, for example, within a range of from about 50 decibels to 70 decibels, for example, 60 decibels. The predetermined threshold value for active noise control may be the same as that used for passive noise control, or may be a different threshold value which is less than the passive noise control threshold noise value.

Figure 7:
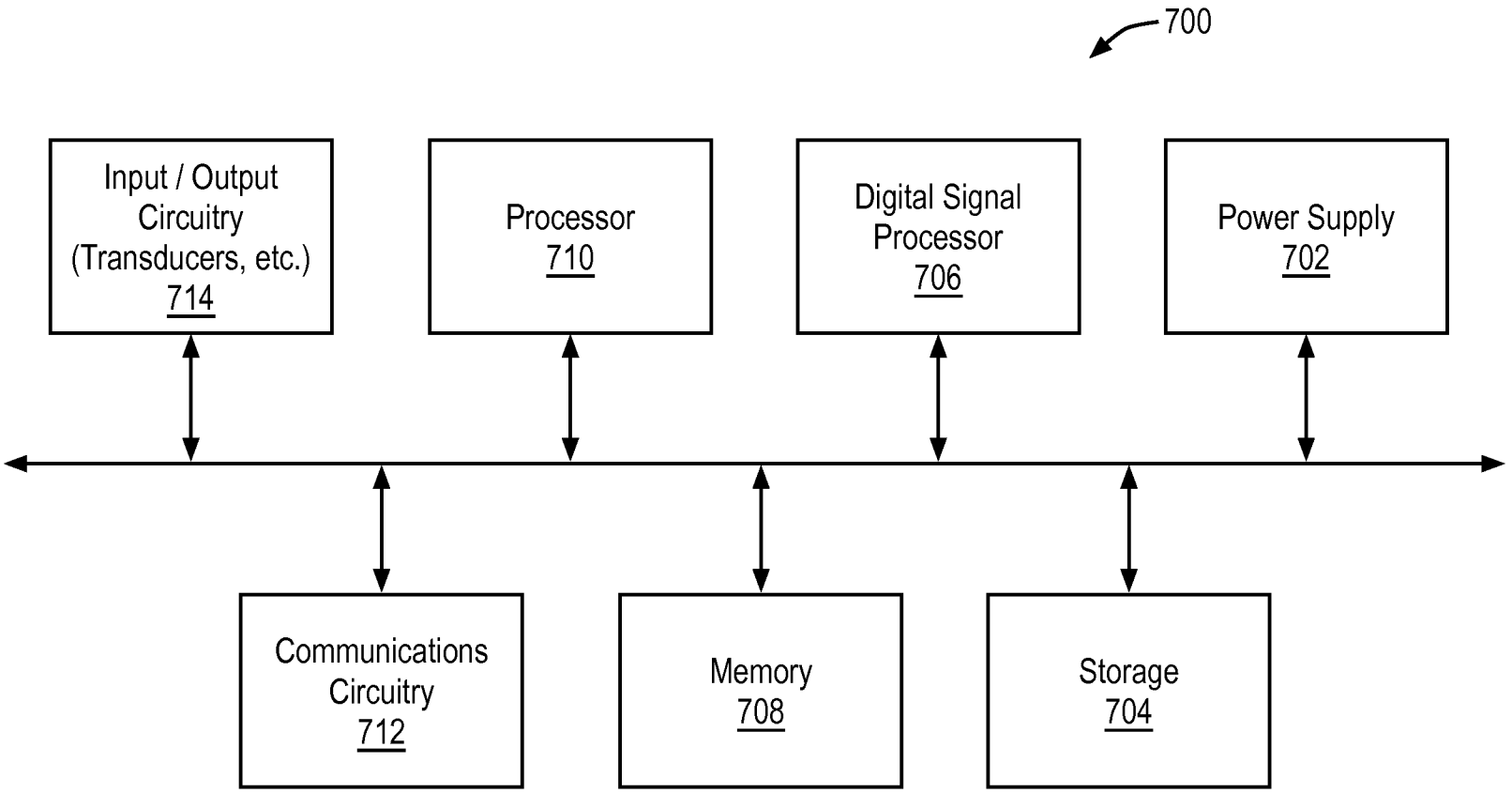
FIG. 7 illustrates a simplified schematic view of one embodiment of an electronic device in which a passive noise control assembly and an active noise control assembly may be implemented.

FIG. 7 illustrates a simplified schematic view of one embodiment of an electronic device in which a passive noise control assembly and an active noise control assembly may be implemented. For example, headphone 100 of FIGS. 1A-1B and headphone 200 of FIGS. 2A-2B are examples of systems that can include some or all of the circuitry illustrated by electronic device 700.

Electronic device 700 can include, for example, power supply 702, storage 704, signal processor 706, memory 708, processor 710, communication circuitry 712, and input/output circuitry 714. In some embodiments, electronic device 700 can include more than one of each component of circuitry, but for the sake of simplicity, only one of each is shown in FIG. 7. In addition, one skilled in the art would appreciate that the functionality of certain components can be combined or omitted and that additional or less components, which are not shown in FIGS. 1A-FIG. 1B, FIGS. 2A-2B and FIG. 3, can be included in, for example, headphone 100 or headphone 200.

Power supply 702 can provide power to the components of electronic device 700. In some embodiments, power supply 702 can be coupled to a power grid such as, for example, a wall outlet. In some embodiments, power supply 702 can include one or more batteries for providing power to a headphone or other type of electronic device associated with the headphone. As another example, power supply 702 can be configured to generate power from a natural source (e.g., solar power using solar cells).

Storage 704 can include, for example, a hard-drive, flash memory, cache, ROM, and/or RAM. Additionally, storage 704 can be local to and/or remote from electronic device 700. For example, storage 704 can include integrated storage medium, removable storage medium, storage space on a remote server, wireless storage medium, or any combination thereof. Furthermore, storage 704 can store data such as, for example, system data, user profile data, and any other relevant data.

Signal processor 706 can be, for example a digital signal processor, used for real-time processing of digital signals that are converted from analog signals by, for example, input/output circuitry 714. After processing of the digital signals has been completed, the digital signals could then be converted back into analog signals. For example, the signal processor 706 could be used to analyze digitized audio signals received from ambient or error microphones to determine how much of the audio signal is ambient noise or earcup noise and how much of the audio signal is, for example, music signals.

Memory 708 can include any form of temporary memory such as RAM, buffers, and/or cache. Memory 708 can also be used for storing data used to operate electronic device applications (e.g., operation system instructions).

In addition to signal processor 706, electronic device 700 can additionally contain general processor 710. Processor 710 can be capable of interpreting system instructions and processing data. For example, processor 710 can be capable of executing instructions or programs such as system applications, firmware applications, and/or any other application. Additionally, processor 710 has the capability to execute instructions in order to communicate with any or all of the components of electronic device 700. For example, processor 710 can execute instructions stored in memory 708 to enable or disable ANC, or instructions to open or close a passive control assembly valve.

Communication circuitry 712 may be any suitable communications circuitry operative to initiate a communications request, connect to a communications network, and/or to transmit communications data to one or more servers or devices within the communications network. For example, communications circuitry 712 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 714 can convert (and encode/decode, if necessary) analog signals and other signals (e.g., physical contact inputs, physical movements, analog audio signals, etc.) into digital data. Input/output circuitry 714 can also convert digital data into any other type of signal. The digital data can be provided to and received from processor 710, storage 704, memory 708, signal processor 706, or any other component of electronic device 700. Input/output circuitry 714 can be used to interface with any suitable input or output devices, such as, for example, ambient microphone 124, error microphone 126 or sound source 130 of FIGS. 1A-1B and FIGS. 2A-2B. Furthermore, electronic device 700 can include specialized input circuitry associated with input devices such as, for example, one or more proximity sensors, accelerometers, etc. Electronic device 700 can also include specialized output circuitry associated with output devices such as, for example, one or more speakers, earphones, etc.

Lastly, bus 716 can provide a data transfer path for transferring data to, from, or between processor 710, storage 704, memory 708, communications circuitry 712, and any other component included in electronic device 700. Although bus 716 is illustrated as a single component in FIG. 7, one skilled in the art would appreciate that electronic device 700 may include one or more components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the passive noise control system described herein may be used to improve an acoustic response of any type of earpiece with acoustic capabilities, for example, earbuds, earphones, intra-canal earphones, intra-concha earphones or a mobile phone headset. The description is thus to be regarded as illustrative instead of limiting.

What is claimed is:

1. An adaptive noise-cancelling headphone comprising:

an earcup comprising an earcup housing having a front portion defining an inner chamber dimensioned to encircle a user's ear, a back portion defining an outer chamber and a mid wall separating the inner chamber from the outer chamber;

a driver positioned within the mid wall for outputting sound to the inner chamber and in a direction of a user's ear;

an active noise control assembly integrated with the earcup housing, the active noise control assembly having an ambient microphone operable to detect an ambient sound outside of the earcup housing and an error microphone operable to detect an earcup sound inside of the earcup housing; and a passive noise control assembly integrated with the earcup housing, the passive noise control assembly having an acoustic valve associated with an acoustic vent that opens to the outer chamber, the acoustic valve operable to be modified between an open configuration to decrease ambient sound attenuation within the earcup housing and a closed configuration to increase ambient sound attenuation within the earcup housing in response to the detected ambient sound.

2. The adaptive headphone of claim 1 wherein the ambient microphone is positioned at the back portion of the earcup housing.

3. The adaptive headphone of claim 1 wherein the error microphone is positioned within the front portion of the earcup housing such that it detects the earcup sound near the user's ear.

4. The adaptive headphone of claim 1 further comprising:

a cancelling signal generating unit capable of generating a cancelling signal when active noise cancellation is enabled.

5. The adaptive headphone of claim 1 wherein the acoustic vent is positioned within the back portion of the earcup housing and the driver includes a leak port such that when the acoustic valve is in the open position, the ambient sound outside of the earcup housing enters the outer chamber through the acoustic vent and travels to the inner chamber through the leak port.

6. The adaptive headphone of claim 1 wherein the back portion of the earcup housing further comprises a middle chamber, wherein the middle chamber surrounds the driver and the outer chamber is behind the middle chamber, and wherein the acoustic vent is positioned between the middle chamber and the outer chamber such that when the valve is in the open position, the middle chamber vents to the outer chamber.

7. The adaptive headphone of claim 1 wherein active noise cancellation is enabled when it is determined, based on an ambient noise electrical signal output by the ambient microphone and an earcup noise electrical signal output by the error microphone, that the earcup sound inside the earcup housing is above a predetermined threshold value.

8. The adaptive headphone of claim 1 wherein the acoustic valve is in the closed configuration when the ambient sound is above a predetermined threshold value.

9. The adaptive headphone of claim 1 wherein the acoustic valve is in the open configuration when the ambient sound is below a predetermined threshold value.

10. The adaptive headphone of claim 1 wherein active noise cancellation is disabled when the acoustic valve is in the open configuration.

11. An adaptive noise-cancelling headphone system comprising:

a headphone having a set of earcups, each of the earcups comprising an earcup housing having an inner chamber dimensioned to encircle a user's ear and an outer chamber separated from the inner chamber by a mid wall, a driver mounted within the mid wall and operable to output sound to the user's ear, an ambient microphone operable to detect an ambient noise outside of the earcup housing and output an ambient noise electrical signal and an error microphone operable to detect an earcup noise within the earcup housing and output an earcup noise electrical signal;

a processor configured to:

receive one or more of the ambient noise electrical signal and the earcup noise electrical signal;

compare the ambient noise electrical signal or the earcup noise electrical signal to a predetermined threshold value; and based on the comparing, operate an active noise control system of the headphone and a passive noise control system of the headphone to improve an acoustic performance of the headphone.

12. The headphone system of claim 11 wherein the active noise control system comprises:

a cancelling signal generating unit configured to generate a cancelling signal capable of cancelling the earcup noise.

13. The headphone system of claim 11 wherein the passive noise control system comprises:

a modifiable acoustic valve associated with a vent formed in the earcup housing and opening to the outer chamber.

14. The headphone system of claim 11 wherein the processor is configured to instruct the passive noise control system to decrease ambient sound attenuation within the earcup housing when the ambient noise electrical signal is below the predetermined threshold value.

15. The headphone system of claim 11 wherein the processor is configured to instruct the passive noise control system to increase ambient sound attenuation within the earcup housing when the ambient noise electrical signal is above the predetermined threshold value.

16. The headphone system of claim 11 wherein the processor is configured to instruct the passive noise control system to decrease ambient sound attenuation within the earcup housing and instruct the active noise control system to turn off when the ambient noise electrical signal is below the predetermined threshold value.

17. The headphone system of claim 11 wherein the processor is coupled to a memory, the memory having store therein operating system instructions to be implemented by the processor, and the processor and the memory are contained within the headphone.

18. A method of adaptively cancelling noise within a headphone comprising:

determining an ambient noise outside of an earcup housing using an ambient microphone associated with the earcup housing, the earcup housing having an inner chamber dimensioned to encircle a user's ear, an outer chamber separated from the inner chamber by a mid wall and a driver positioned within the mid wall for outputting sound to the inner chamber;

determining an earcup noise inside of the earcup housing using an error microphone associated with the earcup housing;

actively controlling the earcup noise using an active noise control assembly when the earcup noise is above a predetermined threshold value; and passively controlling ambient noise attenuation within the earcup housing using a passive noise control assembly having an acoustic valve associated with an acoustic vent that opens to the outer chamber.

19. The method of claim 18 wherein actively controlling the earcup noise comprises instructing the active noise control assembly to generate a noise cancelling signal sufficient to cancel the earcup noise.

20. The method of claim 18 wherein passively controlling ambient noise attenuation within the earcup housing comprises instructing the passive noise control assembly to open the acoustic valve to decrease attenuation of the ambient noise when the ambient noise is below a predetermined threshold value.

21. The method of claim 18 wherein passively controlling ambient noise attenuation within the earcup housing comprises instructing the passive noise control assembly to close the acoustic valve to increase attenuation of the ambient noise when the ambient noise is above a predetermined threshold value.

* * * * *